United States Patent [19]

York

[11] Patent Number: 4,919,405

[45] Date of Patent: Apr. 24, 1990

[54] FLETCHING TOOL

[76] Inventor: Merineth S. York, 639 S. Elm St., Mesa, Ariz. 85202

[21] Appl. No.: 325,904

[22] Filed: Mar. 20, 1989

[51] Int. Cl.[5] ..... B25B 1/20

[52] U.S. Cl. ..... 269/38

[58] Field of Search ..... 294/100; 269/38, 274, 269/156, 239, 3, 6, 907; 81/3.8, 4

[56] References Cited

U.S. PATENT DOCUMENTS

| | | | |
|---|---|---|---|
| 781,277 | 1/1905 | Fahey | 81/4 |
| 2,918,097 | 12/1959 | Thompson | 269/156 |
| 2,947,564 | 8/1960 | Winther | 294/100 |
| 4,653,738 | 3/1987 | York | 269/38 |
| 4,749,175 | 6/1988 | Grabits | 269/38 |

*Primary Examiner*—Robert C. Watson

*Attorney, Agent, or Firm*—James F. Duffy

[57] ABSTRACT

A fletching guide for attaching pre-formed flights to arrow shafts. Fletching guides, in number equivalent to the number of flights to be attached to an arrow shaft, are splayed outwardly from the central axis of the tool. Pre-formed flights are placed in the guide and adhesive is applied along the edge of the flight which will contact the arrow shaft. The guides bearing the flights with adhesive applied are then moved to a position so as to embracingly encompass the arrow shaft and hold the flights in position until the adhesive has cured. To accommodate special circumstances, a nock aligning means within the tool is rotatingly displacable so as to selectedly position the arrow flights on the arrow shaft in a desired geometric relationship with the nock at the end of the arrow shaft. A compressive closure cap at the distal ends of the fletching guides assures a uniform compressive force applied along the length of the guides and aligns the guides for true and proper placement of the flights on the arrow shaft.

16 Claims, 2 Drawing Sheets

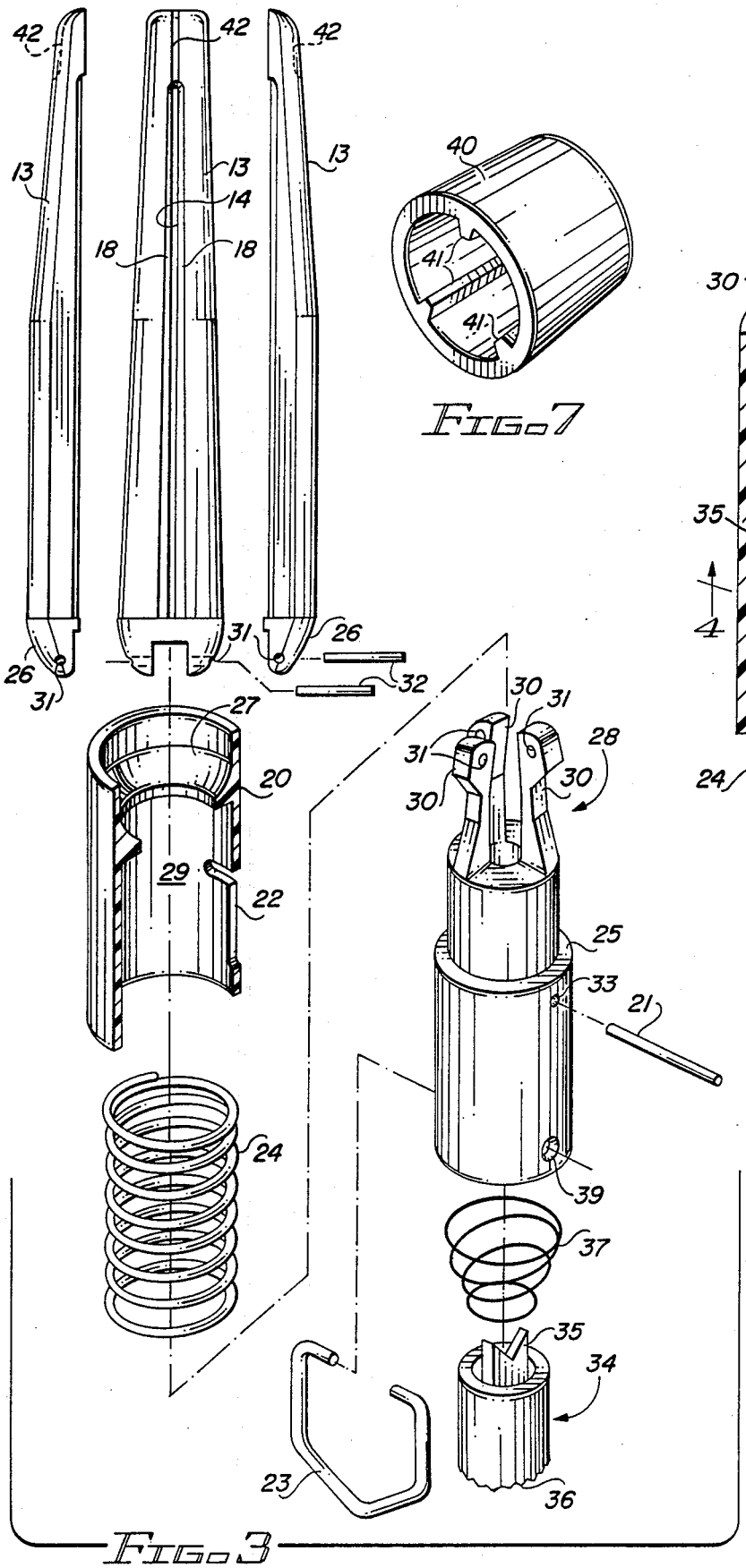
FIG. 3
FIG. 7
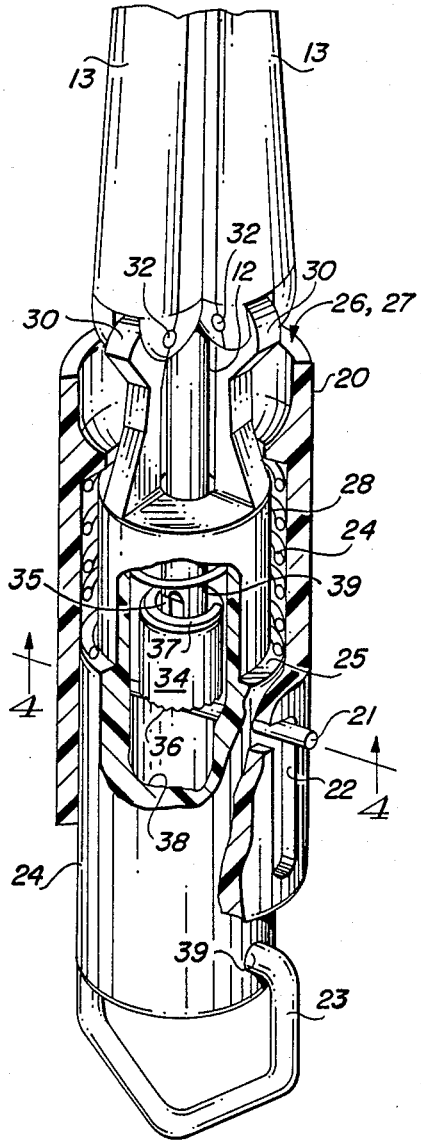
FIG. 6

FLETCHING TOOL

BACKGROUND

1. Field of the Invention

The invention relates to the art of fletching arrows, i.e., the attaching of an arrow to the shaft of feathers or pre-molded imitation feathers either of which are often referred to as flights. In particular, the invention relates to a tool which permits the rapid and precise application of several flights to an arrow shaft at one time.

2. Prior Art

The most closely related, known prior art is set forth in U.S. Pat. No. 4,653,738 issued Mar. 31, 1987 to the inventor herein. The fletching tool described in that patent provided a spool with a bore to receive the shaft of an arrow. Coupled to the spool were a multiplicity of fletching guides each having provision for accepting a pre-molded flight. The fletching guides were splayed outward away from the shaft while the pre-molded flights were inserted therein. The guides were then moved so as to encompass the shaft in a manner which would permit adhesive, previously affixed to the flights, to adhere the flights to the shaft. A cap or collar was drawn down over the distal ends of the fletching guides to retain them in position for a sufficient time to complete the bond between arrow shaft and flight.

While the inventor's prior art fletching tool represented a significant advance over the then state of the art, it is an object of the present invention to advance the state of the fletching art even further.

SUMMARY OF THE INVENTION

The invention is presented and claimed as an improvement in a fletching tool; the fletching tool being a device for precisely aligning and adhering fletching to an arrow shaft. The fletching tool on which the improvement is disclosed comprised a spool means for matingly receiving an arrow shaft preparatory to affixing fletching to the shaft. The tool had a plurality of fletching guides splayably coupled to the spool and being splayable away from an arrow shaft mated with the spool; this at the beginning and the end of the fletching operation. The fletching guides were also movable to embracingly encompass an arrow shaft while fletching was being adhered to the shaft. The improvement is disclosed and claimed as closure means which are coupled to the spool in a manner as to cause a compressive loading of the fletching guides while they are embracingly encompassing an arrow shaft. The compressive loading is generally applied to the fletching guides adjacent to the spool means. Spring loading means are made available to maintain the compressive loading.

At the distal ends of the fletching guides a collar is provided to compressingly engage the distal ends of the guides while they embracingly encompass the arrow shaft. In a preferred embodiment the collar has alignment means for locating and retaining the distal ends of the fletching guides in alignment for precise placement of flights on an arrow shaft.

A significant improvement is achieved by emplacing an arrow nock engaging/aligning means within the spool means. Provision has been made to rotate the nock engaging/aligning means within the spool means about an axis coincident with the longitudinal axis of the spool means. The nock engaging/aligning means does not rotate freely but rather moves in selected increments controlled by a detent which movably restrains the engaging and aligning means at selected positions within the spool means.

Another significant improvement which permits the fletching tool to be used with arrows of a variety of diameters is a mandril within the spool means. The mandril is comprised of a plurality of compression arms. The closure means, noted earlier, is removably and compressingly coupled to the compression arms so as to removably bring the compression arms into compressive contact with an arrow shaft when such a shaft is mated with the spool means.

DESCRIPTION OF THE DRAWINGS

FIG. 3 is an exploded assembly drawing of the tool.

FIG. 6 is a sectional view of the assembled tool with an arrow shaft in place and the fletching guides and compressive arms about to be compressed by the spring loaded closure means near the base of the tool.

FIG. 7 illustrates the interior of the compressive collar which is removable coupled to the distal end of the fletching guides to bring them into precise alignment for accurate placement of the flights on the arrow shaft as well as for maintaining the distal ends of the guides in compression against the arrow shaft within their embrace.

A DETAILED DESCRIPTION OF THE INVENTION

Figure 1:
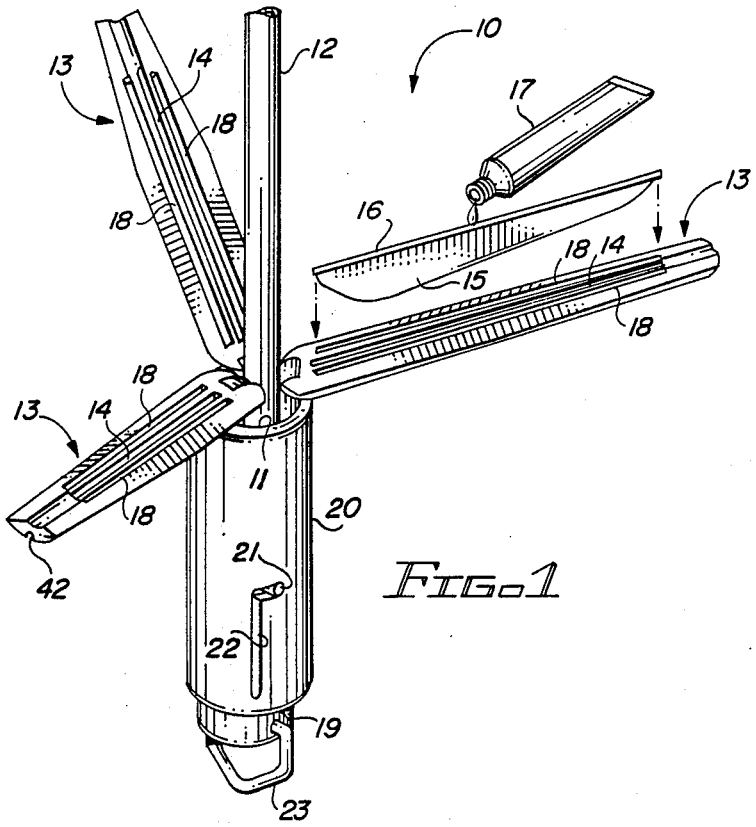
FIG. 1 is a perspective view of the tool with the fletching guides splayed outward away from the arrow shaft and illustrating the manner in which a preformed flight is inserted into the fletching guide and adhesive applied to the flight.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Figure 2:
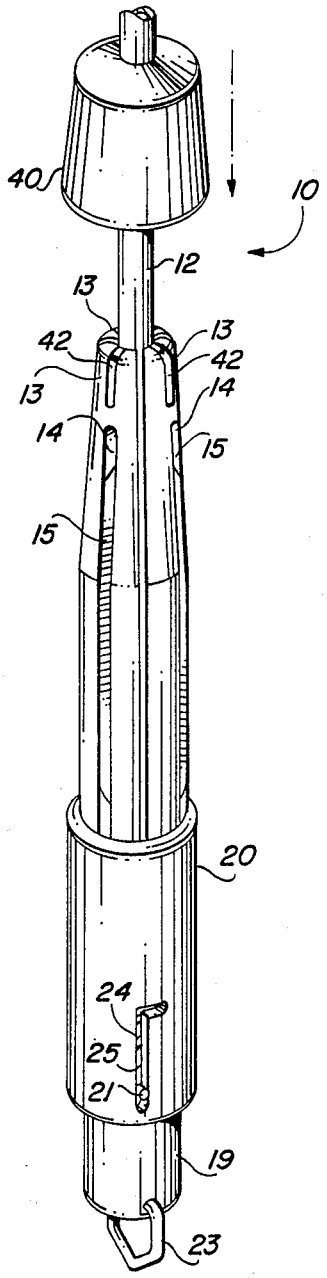
FIG. 2 is a perspective view of the fletching tool wherein the fletching guides are maintained in compressive embracing contact with an arrow shaft by means of a spring loaded closure means at the lower end of the guides, as depicted. A compressive collar is about to be emplaced at the distal end of the guides.

The fletching tool of the invention 10 is illustrated in FIG. 1. Tool 10 has a central bore or opening 11 into which an arrow shaft 12 is matingly emplaced. Three fletching guides 13 are illustrated splayed outward away from arrow shaft 12. Although only three fletching guides 13 are illustrated, no limitation on the number of fletching guides is implied. Guides 13 may be splayed outward as illustrated in FIG. 1 or moved upward to embracingly encompass arrow shaft 12 as illustrated in FIG. 2.

Each of guides 13 has a pass-through, slotted bore 14 which receives the flight portion of pre-formed fletching 15 as indicated by the arrows in FIG. 1. To fletch an arrow shaft, pre-formed fletching 15 is inserted in each of the slots 14 in each of the guides 13. Each flight 15 has an adhesive receiving surface 16 to which an adhesive material 17 is applied.

With the adhesive applied to each surface 16 of the individual flight tool fletchings 15, the guide arms are allowed to move from their splayed position upwards so as to embrace the arrow shaft and draw the adhesive into contact with the arrow shaft. When the guides are moved upwards to embrace the arrow shaft, as illustrated in FIG. 2, a compression cap 40 is passed downward over the distal ends of the guides 13 to add to the compressive force applied by guides 13 to arrow shaft 12 and to maintain guides 13 and alignment.

Returning to FIG. 1: arrow shaft 12 passes downward into central opening 11 of tool 10 to matingly engage within a bore within slide shaft or spool 19. Spool 19 houses a nock engaging/aligning means which is positioned to mate with the nock end of the arrow shaft so as to orient the arrow shaft for proper emplacement of the flights on the shaft.

FIG. 3 is an exploded assembly of tool 10. FIG. 6 is a partial sectional view of the assembly of tool 10. Central to the assembly of tool 10 is slide shaft or spool 19. Spool 19 contains a counter-bore 42 having an upper diameter, illustrated in FIG. 3 and FIG. 6, of a size to guidingly accept an arrow shaft 12. Counter-bore 42 opens to a larger diameter within spool 19 to accept the arrow nock engaging/aligning means 34. Nock engaging/aligning means 34 contains a nock engaging extension 35 which engages with the nock end 39 of shaft 12 as suggested in FIG. 5 and illustrated in FIG. 6.

Figure 4:
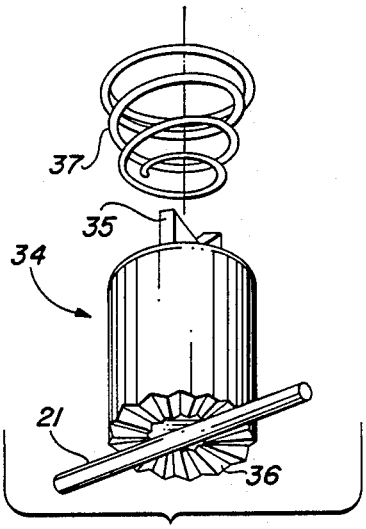
FIG. 4 is a perspective detailed drawing of the arrow nock engaging/aligning means and depicting the detent arrangement at the base of the said means.
Figure 5:
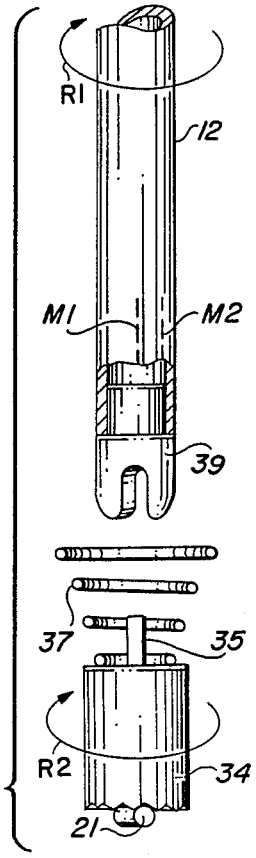
FIG. 5 is a partial exploded assembly drawing showing the manner in which the nock of an arrow shaft, upon engaging the nock engaging and aligning means, is utilized to rotate the aligning and engaging means to various positions established by the detent.

To assemble the nock engaging and aligning means 34 within spool 19, a helical spring 37 is first emplaced about nock engaging extension 35, as illustrated in FIG. 5. The resulting subassembly is then inserted upwards into counter-bore 42 of spool 19 a distance so as to compress spring 37 and allow the insertion of pin 21 into spool 19 passing through bore 42 beneath nock engaging and aligning means 34. This assembly is illustrated in FIG. 6 and details of the relationship among spring 37 nock engaging and aligning means 34 and pin 21 are illustrated in FIGS. 4 and 5.

As is best seen in FIG. 4, nock engaging and aligning means 34 carries a multiplicity of detent notches 36 at its base. These detent notches matingly engage with pin 21. The engagement between detent notches 36 and pin 21 is maintained by the force exerted by spring 37; note the assembly in FIG. 6. The notch 36 and pin 21 detent arrangement allow nock engaging and aligning means 34 to be rotated in controlled increments. The manner of moving nock aligning and engagement means from one incremental position to another is illustrated in FIG. 5.

In fletching an arrow the flights are typically oriented such that one flight lies in a plane orthogonal to the bow string when the arrow and string are engaged. However, the hunting and sporting bowman has available to him a variety of arrow supports which are coupled to the bow itself. For proper functioning, without misdirection of the path of the arrow from the bow, certain arrow supports require that the arrangement of the flights on the arrow shaft be offset from the conventional position. To this end, the invention provides for the incremental rotation of the nock engaging and aligning means 34 such that in fletching an arrow the flights may be positioned properly for use with the arrow support being utilized by the bowman.

Referring again to FIG. 1: arrow 12 is inserted into tool 10 through central opening 11 from whence it passes into the top of counter-bore 42 in slide shaft or spool 19. It continues this passage until nock end 39 of arrow shaft 12 engages with nock engaging extension 35 of the engaging and alignment means 34. When a preformed flight 15 is emplaced within fletching guide 13 and the guides raised upwards to adhere the flight to the arrow shaft, the flight may, for example, lie along the dashed line M1 indicated in FIG. 5. The bowman however may desire that the flight should lie instead, along M2 of FIG. 5.

To accomplish this desired end, arrow shaft 12, with nock end 13 engaged with nock engaging extension 35, is rotated in the direction indicated by the arrow R1. The force of this rotation of arrow shaft 12 is communicated through nock engaging extension 35 causing nock engaging and aligning means 34 to overcome the force exerted by spring 37. The effect of overcoming this spring loaded force is to permit nock engaging and aligning means 34 to rotate in the direction of arrow R2 such that pin 21 now engages in an adjacent notch detent 36 from that in which it was originally engaged. In this manner the nock engaging and aligning means 34 may be rotated to a position which provides for adhering fletching to arrow shaft 12 in accord with the geometry required by a specific selected arrow support device used by the archer.

It should be noted in FIG. 3, that when an arrow shaft 21 is inserted into the counter-bored opening 42 of spool 19, this shaft must pass through a mandril 28 having compression arms 30. See FIG. 6 as well. Mandril 28 with its compression arms 30 extends the usefulness of the tool 10 in that a variety of arrow shafts 21 of different diameters may be fletched using tool 10. Counterbore opening 42 is of a diameter to accept the largest size arrow shaft anticipated for use with the tool. Compression arms 30 of mandril 28 may then be compressed inward to embrace the arrow shaft and hold it in place. This arrangement is shown in FIG. 6.

The assembly of the elements of tool 10, shown in FIG. 3, into the finished tool illustrated in FIG. 6 proceeds as follows: Helical spring 24 is inserted over mandril 28 coming to rest on shoulder 25 of spool 19. Locking cylinder 20 is next emplaced over both spring 24 and mandril 28. Locking cylinder 20 will be disclosed as the means for closing fletching guides 13 about arrow shaft 12.

With spring 24 and locking cylinder 20 emplaced on mandril 28, the subassembly of helical spring 37 and nock engaging and aligning means 34 are inserted upward into counter-bore 42.

The inverted L-shaped slot 22 is oriented to align with hole 33 in spool 19. Appropriate compressive forces are applied to the parts to permit pin 21 to be inserted through slot 22 and into hole 33 where it will pass beneath the detent notches 36 of nock engaging and aligning means 34 to engage in a similar opposite hole 33 whereby pin 21 will be maintained in position acting as detent pin for nock engaging and aligning means 34 and as the locking key, within slot 22, for the closure means, locking cylinder 20.

At this point fletching guides 13 may be emplaced in the assembly. Spool 19 is pushed upwards into locking cylinder 20 so as to compress helical spring 24 and permit the emplacement of pin 21 in place within the horizontal leg of the inverted L-shaped slot 22. This arrangement locks spool 19 and cylinder 20 in position with the compression arms 30 of mandril 28 extending outside the boundaries of cylinder 20. This will permit fletching guides 13 to be assembled to compression arms 30.

Fletching guides 13 have a rounded end 26 having a hinge pine bore 31 to accept hinge pin 32. The compression arms 30 of mandril 28 also have matching hinge pin bores 31. One fletching guide 13 is coupled to each of compression arms 30 and hinge pin 32 is inserted in bore 31 so as to hingedly couple the fletching arm 13 to compression arm 30. The fletching guides may now be splayed outward, in the manner shown in FIG. 1, or move upwards to embracingly enclose an arrow shaft 12 as indicated in FIG. 2.

Assume for the moment that fletching guides 13 are splayed outwardly as indicated in FIG. 1. When locking cylinder 20 is rotated so as to remove pin 21 from the horizontal leg of inverted L-shaped slot 22, a relative motion between spool 19 and locking cylinder 20 is induced by action of spring 24 as it expands. Spool 19 moves downward with respect to locking cylinder 20; locking cylinder 20 moves upward with respect to spool 19. In either event, compression arms 30 of mandril 28 are drawn within the slopingly decreasing diameter 27 of locking cylinder 20. This results in compression arms 30 being compressed inwardly to lockingly embrace an arrow shaft inserted into counter-bore 42.

At the same time that locking cylinder 20 is moving upward and causing compression arms 30 to compress inwardly, the rounded ends 26 of fletching guides 13 are also drawn within the sloping, decreasing diameter end 27 of cylinder 20. As the fletching guides are so drawn into cylinder 20, each guide is forced to rotate upwardly about hinge pin 32 to be placed into an intimate, embracing contact with arrow shaft 12.

The erection of the fletching guides 13 will bring the pre-formed fletching 15 into contact with the arrow shaft 12 so that the adhesive 17 applied to contact edge 16 of fletching 15 will make adhering contact with the arrow shaft 12.

Adequate pressure is maintained at the lower end of fletching guides 13 as a result of the closing force exerted by their spring loaded entry into the sloping reduced diameter end of locking cylinder 20. To assure the application of adhering pressure is uniform along the length of fletching guides 13, a compression cap 40 is inserted downward over the distal ends of fletching guides 13. The result of this exercise is that pressure is applied to both the distal ends of guides 13 as well as the hinged ends and the adhering pressure applied to the contact edge 16 of pre-formed fletching 15 is generally uniform along the length of the pre-formed fletching and a good adhesion results.

To prevent a misapplication of the flights to the arrow shaft, due to an inadvertent skewing of fletching guides 13 about arrow shaft 12, compression cap 40 is provided with interior ridges 41 which mate with slots 42 at the distal ends of fletching guides 13. When ridges 41 are matingly engaged in slots 42, the possibility of guides 13 being skewed along their path of contact with arrow shaft 12 becomes obviated. The pre-formed fletching will thus be positively adhered to and accurately aligned along arrow shaft 12.

For convenience of handling, a D-ring 23 is matingly engaged with holes 39 (only one of which is illustrated) in spool 19. The D-ring provides a means for grasping the tool while exercising locking cylinder 20 along the surface of spool 19 to compress and relax spring 24 to close or release fletching guides 13.

What has been disclosed is a fletching guide for attaching pre-formed flights to arrow shafts. Fletching guides, in number equivalent to the number of flights to be attached to an arrow shaft, are splayed outwardly from the central axis of the tool. Pre-formed flights are placed in the guide and adhesive is applied along the edge of the flight which will contact the arrow shaft. The guides bearing the flights with adhesive applied are then moved to a position so as to embracingly encompass the arrow shaft and hold the flights in position until the adhesive has cured. To accommodate special circumstances, a nock aligning means within the tool is rotatingly displacable so as to selectedly position the arrow flights on the arrow shaft in a desired geometric relationship with the nock at the end of the arrow shaft. A compressive closure cap at the distal ends of the fletching guides assures a uniform compressive force applied along the length of the guides and aligns the guides for true and proper placement of the flights on the arrow shaft.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. In a fletching tool, for precisely aligning and adhering fletching to an arrow shaft, comprising spool means for matingly receiving an arrow shaft preparatory to affixing fletching thereto, a plurality of fletching guides splayably coupled to said spool and being splayable away from an arrow shaft mated with said spool upon initiation and completion of a fletching operation and embracingly encompassing an arrow shaft while fletching is adhered to the arrow shaft, the improvement comprising:

closure means coupled to said spool means for compressively loading the embrace of said fletching about an arrow shaft adjacent said spool means; and said spool means further comprises arrow nock engaging/aligning means coupled internal to said spool means.

2. The improvement of claim 1 wherein said closure means further comprises spring loading means for maintaining said compressive loading.

3. The improvement of claim 1 further comprising collar means removably coupled to the distal ends of said fletching guides for compressingly engaging the distal ends of said guides when said guides embracingly encompass an arrow shaft.

4. The improvement of claim 3 wherein said collar means further comprises alignment means for locating and retaining the distal ends of said fletching guides in alignment for precise placement of fletching on an arrow shaft.

5. The improvement of claim 1 wherein said arrow nock engaging/aligning means further comprises means for rotating said nock engaging/aligning means within said spool means.

6. The improvement of claim 5 wherein said means for rotating said nock engaging/aligning means further comprises detent means for movably restraining said engaging and aligning means at selected positions with respect to its rotation within said spool means.

7. The improvement of claim 6 wherein said spool means further comprises a plurality of compression arms and said closure means is removably, compressingly coupled to said compression arms to removably bring said compression arms into compressive contact with an arrow shaft mated with said spool means.

8. The improvement of claim 1 wherein said spool means further comprises a plurality of compression arms and said closure means is removably, compressingly coupled to said compression arms to removably bring said compression arms into compressive contact with an arrow shaft mated with said spool means.

9. The improvement of claim 8 wherein said arrow nock engaging/aligning means further comprises means for rotating said nock engaging/aligning means within said spool means.

10. The improvement of claim 9 wherein said means for rotating said nock engaging/aligning means further comprises detent means for movably restraining said engaging and aligning means at selected positions with respect to its rotation within said spool means.

11. The improvement of claim 10 wherein said closure means further comprises spring loading means for maintaining said compressive loading.

12. The improvement of claim 8 wherein said closure means further comprises spring loading means for maintaining said compressive loading.

13. The improvement of claim 12 further comprising collar means removably coupled to the distal ends of said fletching guides for compressingly engaging the distal ends of said guides when said guides embracingly encompass an arrow shaft.

14. The improvement of claim 13 wherein said collar means further comprises alignment means for locating and retaining the distal ends of said fletching guides in alignment for precise placement of fletching on an arrow shaft.

15. The improvement of claim 14 wherein said arrow nock engaging/aligning means further comprises means for rotating said nock engaging/aligning means within said spool means.

16. The improvement of claim 15 wherein said means for rotating said nock engaging/aligning means further comprises detent means for movably restraining said engaging and aligning means at selected positions with respect to its rotation within said spool means.

* * * * *